US006199518B1

(12) United States Patent
Hotta et al.

(10) Patent No.: US 6,199,518 B1
(45) Date of Patent: Mar. 13, 2001

(54) COOLING DEVICE OF AN ENGINE

(75) Inventors: Takayuki Hotta, Chiryu; Yasuo Ozawa, Kariya, both of (JP)

(73) Assignee: Aisin Seiki Kabushiki Kaisha, Aichi-Pref. (JP)

( * ) Notice: Subject to any disclaimer, the term of this patent is extended or adjusted under 35 U.S.C. 154(b) by 0 days.

(21) Appl. No.: 09/296,605

(22) Filed: Apr. 23, 1999

(30) Foreign Application Priority Data

Apr. 23, 1998 (JP) ..... 10-113411

(51) Int. Cl.[7] ..... F01P 5/10
(52) U.S. Cl. ..... 123/41.44; 123/41.47
(58) Field of Search ..... 123/41.44, 41.29, 123/41.47, 41.02

(56) References Cited

U.S. PATENT DOCUMENTS 4,759,316 7/1988 Itakura ..... 123/41.08
5,095,855 * 3/1992 Fukuda et al. ..... 123/41.44
5,979,394 * 11/1999 Schmidt ..... 123/41.44

FOREIGN PATENT DOCUMENTS 2 160 588 12/1985 (GB) .
62-210287 9/1987 (JP) .
2-135616 11/1990 (JP) .
5-231149 9/1993 (JP) .
9-88585 3/1997 (JP) .
89-04419 3/1989 (WO) .

* cited by examiner

*Primary Examiner*—John Kwon
(74) *Attorney, Agent, or Firm*—Reed Smith Hazel & Thomas LLP

(57) ABSTRACT

A cooling device of an engine includes a first liquid pump driven by decelerated rotation of an engine and for circulating the cooling liquid in the engine. A second liquid pump is driven by electricity and circulates the cooling liquid in the engine as a supplement to the first liquid pump.

3 Claims, 3 Drawing Sheets

COOLING DEVICE OF AN ENGINE

FIELD OF THE INVENTION

The present invention relates to a cooling device of an engine which cools the engine by circulating a cooling liquid.

DESCRIPTION OF THE PRIOR ART

A conventional cooling device of this kind includes a liquid pump which is driven by a rotational force of a crank shaft and which circulates the cooling liquid in a cooling liquid circuit of an engine in order to cool the engine. In this conventional cooling device, the liquid pump is always driven by the rotational force of the crank shaft during engine operation and it is impossible to adjust the flow rate of the cooling liquid discharged by the liquid pump. Therefore, the flow rate or flowing amount of the cooling liquid discharged by the liquid pump becomes larger than the flow rate required for cooling the engine under certain circumstances and the consumption of fuel increases due to the greater load on the engine.

A cooling device which overcomes these drawbacks is disclosed in Japanese patent application laid-open publication No. 62(1987)-210287. This cooling device includes a liquid pump which is driven by the rotational force through an electromagnetic clutch in order to circulate the cooling liquid in the cooling liquid circuit of the engine. In this cooling device, the transmission of the rotational force from the crank shaft to the liquid pump is controlled by the electromagnetic clutch and the liquid pump is efficiently driven by the rotational force of the crank shaft. On the other hand, a driving device for driving a auxiliary apparatus of the engine such as a distributor is disclosed in Japanese utility model application laid-open publication No. 2(1990)-135616. In this driving device, the auxiliary apparatus is driven by the rotation of a cam shaft. If this driving device is used as a driving device for driving a liquid pump for circulating the cooling liquid, the flow rate of the cooling liquid discharged by the liquid pump is prevented from becoming greater than the flow rate required for cooling the engine.

In the cooling device disclosed in the former publication, however, the electromagnetic clutch is disposed so as to be coaxial with a shaft of the liquid pump and to surround the liquid pump, and the size of the liquid pump is increased in the axial and radial directions. As a result, the cooling device is restricted by the space required for installing on the engine. Further, in the device disclosed in the latter publication, since the rotation of the crank shaft is transmitted to the cam shaft while being reduced and the rotational speed of the cam shaft becomes half that of the crank shaft, the flow rate of the cooling liquid required for cooling the engine is not ensured and cooling performance deteriorates.

Recently, a cooling device which includes a liquid pump and an electric motor which drives the liquid pump was suggested and is disclosed in Japanese Patent application laid-open publication No. 5(1993)-231149. The liquid pump is driven by the electric motor in response to the temperature of the cooling liquid. In this cooling device, it is able to more efficiently drive the liquid pump in response to the running condition of the engine. However, since a suitable cooling effect for the engine is obtained only by the liquid pump driven by the electric motor, scaling up of the electric motor is required and therefore the consumption of the electric power out of the system in order to drive the electric motor increases.

SUMMARY OF THE INVENTION

It is, therefore, an object of the present invention to provide an improved cooling device of an engine which overcomes the above drawbacks.

In order to achieve this objective, there is provided a cooling device of an engine which includes a first liquid pump driven by decelerated rotation of an engine for circulating the cooling liquid in the engine and a second liquid pump driven by electricity for circulating the cooling liquid in the engine as a supplement.

BRIEF DESCRIPTION OF THE DRAWINGS

Additional objects and advantages of the present invention will become more apparent from the following detailed description of a preferred embodiment thereof when considered with reference to the attached drawings, in which.

DESCRIPTION OF THE PREFERRED EMBODIMENTS

A cooling device of an engine in accordance with a preferred embodiment of the present invention will be described with reference to attached drawings.

Figure 1:
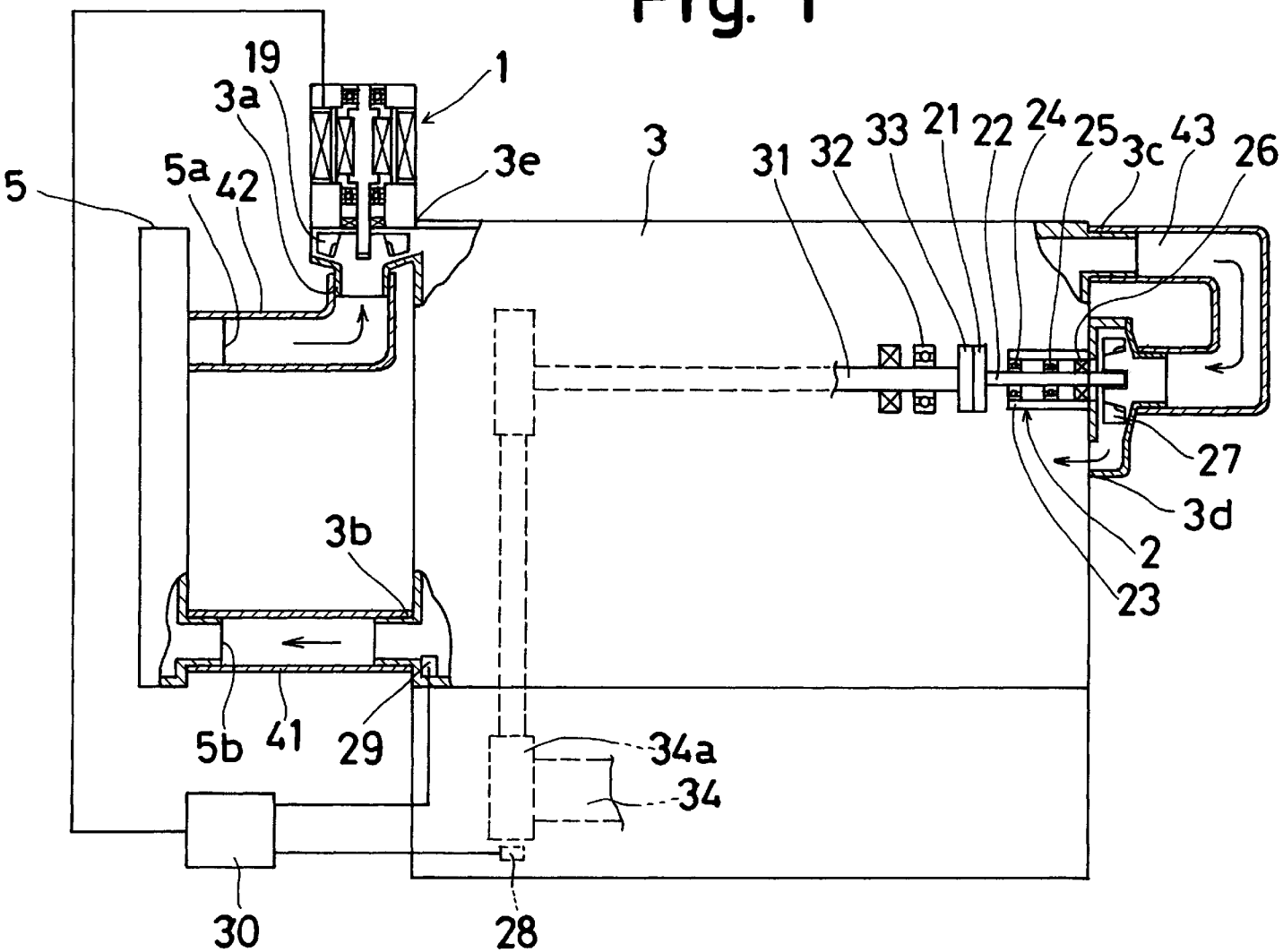
FIG. 1 is a schematic illustration of an embodiment of a cooling device of an engine in accordance with the present invention.

FIG. 1 is a schematic illustration of a cooling device 100 of an embodiment of the present invention. Referring to FIG. 1, the cooling device 100 includes a first liquid pump 2 and a second liquid pump 1. Both of the pumps 1, 2 are installed on an engine 3. A cooling liquid is supplied to the engine 3 through a radiator 5, and the cooling liquid passes in a flowing route which is provided inside of the engine 3. The cooling liquid heated in the engine 3 comes back to the radiator 5 and re-cooled on the way to radiator 5, and circulated in the engine 3 again.

The second liquid pump 1 which is driven by electricity is provided between an outlet port 5*a* of the radiator 5 and the engine 3 to flow the cooling liquid from an outlet port 5*a* of the radiator 5 to the engine 3. A heat-resistance hose 42 is connected an inlet port 3*a* which formed crankshaft pulley 34*a* side of the engine 3 so as to be supplied the cooling liquid into the engine 3 corresponding to the rotation of an impeller 19. A heat-resistance hose 41 is connected between outlet port 3*b* of the engine 3 and the inlet port 5*b* of the radiator 5. The hose 41 is inserted into the outlet port 5*a* and inlet port 3*a*. The hoses 41, 42 are fixed by circular clips (not shown) to ensure the connection of the hoses 41, 42 even when the inside pressure of the hose increases.

The second liquid pump 1 is fixed on established surface 3*e* of the cylinder head by bolts (not shown) so as to face the impeller 19 which receives the output of the second liquid pump 1 to the inlet port 3*a*. In this case, the position of the second liquid pump 1 is not limited to the crankshaft pulley 34*a* side of the engine 3 because the second liquid pump 1 is driven by electricity. Accordingly, it is possible to locate the second liquid pump 1 in any suitable position.

A cam shaft 31 which opens and closes intake and exhaust valves (not shown) extends opposite the crankshaft pulley 34*a* of the engine 3. The rotational speed of the camshaft 31 is decelerated to about half the speed of the rotational speed of the crank shaft 34 comparatively. The first liquid pump 2 is provided coaxially with the camshaft 31 and is driven by the cam shaft 31 so as to rotate at the same speed as the camshaft 31. As a result, the rotational speed of the first liquid pump 2 is decreased to about half the speed of the crank shaft 34.

The first liquid pump 2 is provided in a series in accordance with the flowing direction of the cooling liquid, and heat resistance hose 43 is connected an outlet port 3*c* and an inlet port 3*d*. Therefore, the cooling liquid is supplied into the engine 3 efficiently. An impeller 27 of a first liquid pump 2 which connects to a camshaft 31 is provided in the hose 43. The cooling liquid is circulated inside of the engine 3 by the rotation of the impeller 27.

In this case, the camshaft 31 is rotatably supported on the cylinder head of the engine 3 through bearings 32, and the end of the camshaft 31 is connected by bolts (not shown) through joint elements 33, 21.

The first liquid pump 2 is provided inside of the cylinder head of the engine 3, and housing 23 of the first liquid pump 2 is fixed to the cylinder head by bolts (not shown). A shaft 22 is rotatably supported in the housing 23 through bearings 24, 25 which provide an axial direction. A mechanical seal 26 is provided to prevent invasion of the cooling liquid into the bearings 24, 25. The end of the shaft 22 of the first liquid pump 2 projects into the flowing route between the inlet port 3*d* and outlet port 3*c*, and the impeller 27 is pressed onto the projected end of the shaft 22. Thus, when the engine 3 is driven and the cam shaft 31 is rotated, the impeller 27 rotates with the same rotational speed as that of the cam shaft 31 and the cooling liquid is circulated in the engine 3. Therefore, the amount of the cooling liquid discharged by the first liquid pump 2 becomes about that half amount in comparison with the conventional liquid pump connected to the crank shaft pulley 34*a*. However, any shortage of the cooling liquid is made up by operation of the second liquid pump 1.

Figure 2:
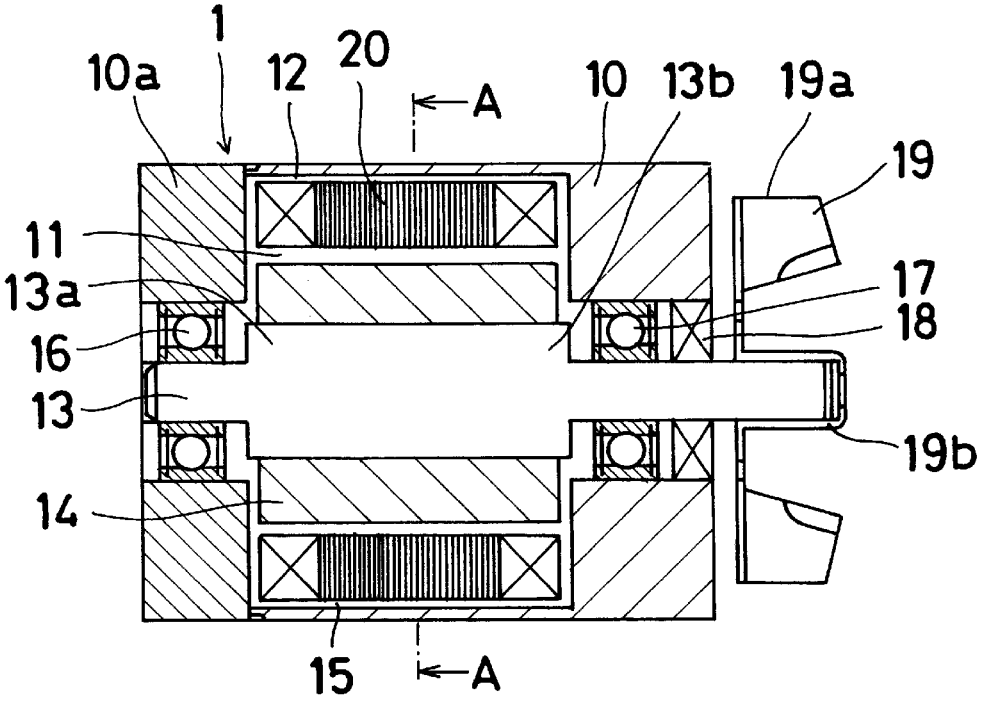
FIG. 2 is a cross-sectional view of a second liquid pump of an embodiment of a cooling device of an engine in accordance with the present invention.

FIG. 2 shows a cross-sectional view of the second liquid pump 1. A cylindrical housing 10 is made of stainless steel and forms an inner space 11 having stepped portions in the axial direction. A ball bearing 17 is provided coaxially with a center shaft 13 made of iron of the housing 10 and the is pressed into one opening of the inner space 11.

Figure 3:
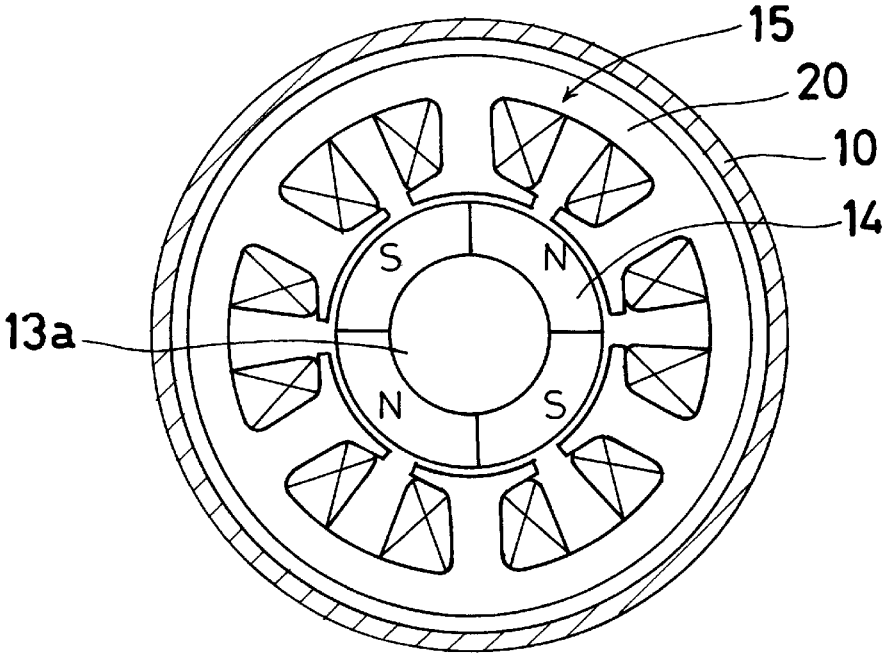
FIG. 3 is a cross-sectional view taken along line A—A in FIG. 2.

The center shaft 13 is provided with a large diameter part 13*a*. A circular magnet 14 is pressed onto the large diameter part 13*a* and is fixed by bonding. An outer surface of the circular magnet 14 has two pair of N poles and S poles alternatingly formed by magnetizing as shown in FIG. 3. It is possible to use separate magnets already magnetized instead of the circular magnet 14, and pole numbers are not limited as shown in FIG. 3. The center shaft 13 is rotatably supported on the housing 17 through the ball bearing 17 at one side in the axial direction.

Figure 4:
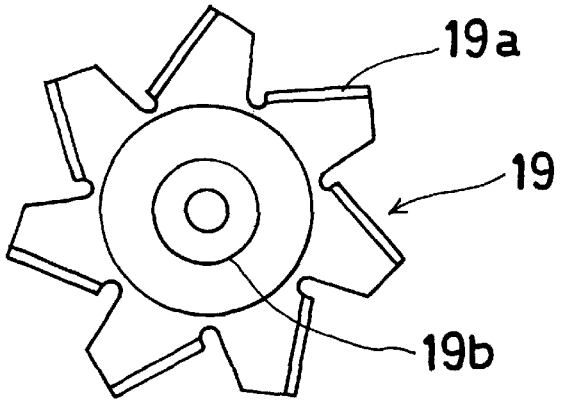
FIG. 4 is a side view of an impeller of the second liquid pump in FIG. 2.

The impeller 19 has a plurality of fins 19*a* as shown in FIG. 4. The center portion 19*b* of the impeller 19 is pressed onto the end of the center shaft 13 and thereby the impeller 19 is arranged so as to be able to rotate in the cooling liquid flowing route.

As shown in FIG. 3, a core 20 is formed by laminating a plurality of ring-shaped iron plates, and a coil portion 15 is formed by turning high heat conductivity coil (for example, made of copper) on the core 20. The coil portion 15 is pressed into the inner space 11 of the housing 10. When the center shaft 13 is disposed in the inner space 11 of the housing 10, a small gap is maintained between the coil portion 15 and the circular magnet 14. The other opening of the inner space 11 of the housing 10 is closed by a cover 10*a* which is fixed to the housing 10 by bolts (not shown). The cover 10*a* is provided with a inner bore into which a bearing 16 is pressed. The center shaft 13 is rotatably supported on the cover 10*a* through the ball bearing 16 at its the other side in the axial direction. The numeral 18 is a well-known mechanical seal which is disposed between the center shaft 13 and the housing 10 in order to prevent the cooling liquid from flowing into the inner space 11.

When three-phase coil portions 15 positioned diagonally are turned on electrically (alternatingly), the coil portions 15 generate electromagnetic force, whereby the second liquid pump 1 is driven. That is to say, a magnetic field is formed between the core 20 and the magnet 14. Turning on the coil portions 15 controls the changing of the N poles and S poles generated in the core 20; the center shaft 13 rotates by absorbing the magnetic flux from the magnet 14 to the coil portion 15.

The rotation of the second liquid pump 1 is controlled based on the output of an engine rotational speed sensor 28 which is provided to the crank shaft pulley 34*a* and a liquid temperature sensor 29. The engine rotational speed sensor 28 detects the engine rotational speed based on pulse signal generated by rotation of the crankshaft 34. And the liquid temperature sensor 29 is provided to the output side of the cooling liquid, having a thermal resistor inside the sensor 29. The thermal resistor takes out variations in the liquid temperature; the resistance value of the thermal resistor increases as the liquid temperature decreases, and the resistance value decreases as the liquid temperature increases.

Figure 5:
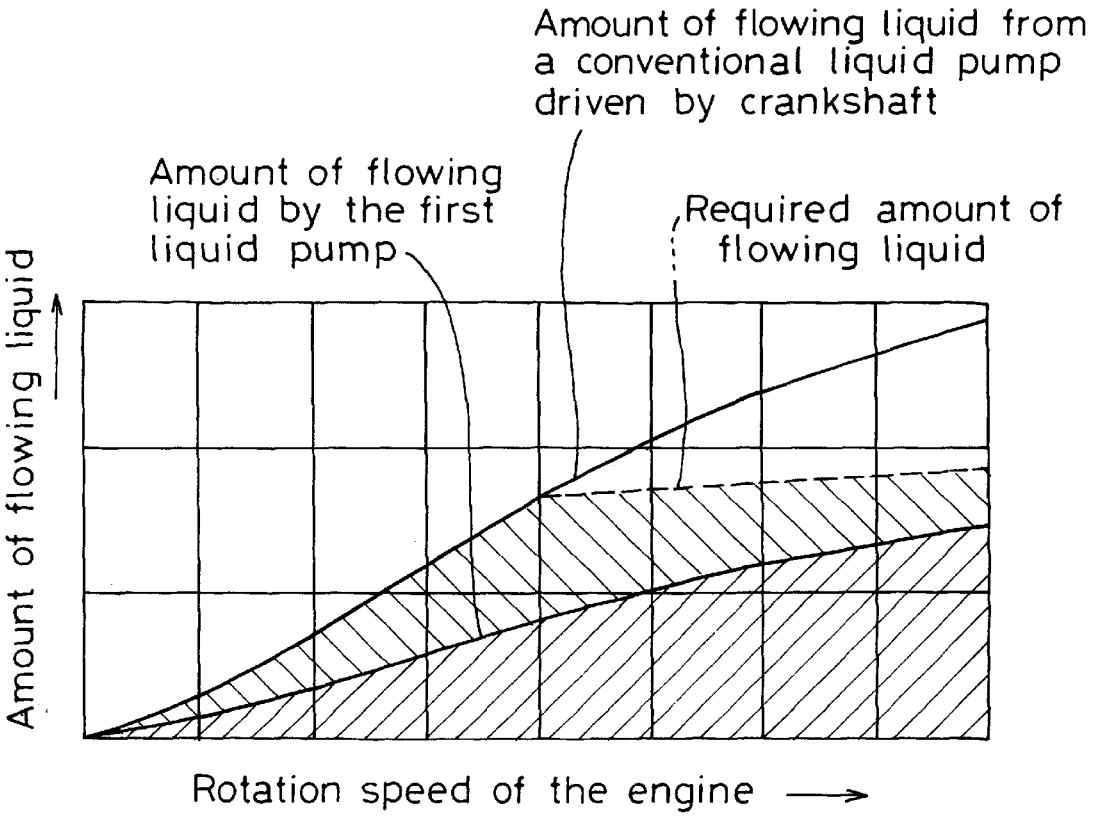
FIG. 5 is a diagram which shows a relationship between the flow rate of the cooling liquid discharged by the liquid pumps and the rotational speed of the engine in the cooling device of the present invention and the prior cooling device.

The amount of flowing cooling liquid which cools the engine 3 is decided as follows. At first, the amount of heat-generation in the engine 3 is calculated when designing the engine 3. The size of the radiator 5 is then determined from above amount of the heat generation. The amount of flowing cooling liquid that corresponds to the engine rotation speed is decided by the size of the radiator 5 as shown in FIG. 5.

The controlling of the rotation of the second liquid pump 1 will now be explained. At first, a controller 30 detects an output signal from the liquid temperature sensor 29. The liquid temperature t1 is judged in terms of a first range (for example, the liquid temperature t1<140° F.), a second range (140° F.<the liquid temperature t1<176° F.), or a third range (the liquid temperature t1>176° F.). The required amount of flowing cooling liquid is decided from the map in FIG. 5. The rotational speed of the second liquid pump 1 is set up based on the rotation of the engine 3 and liquid temperature t1. The amount of flowing liquid by the second liquid pump 1 is calculated from the rotation speed of the second liquid pump 1. It is possible to secure the amount of flowing liquid to cool the engine 3 efficiently by the first liquid pump 2 and the second liquid pump 1 based on FIG. 5.

In other words, the second liquid pump 1 supports the difference between the amount of flowing liquid to cool the engine 3 efficiently as a target value and the amount of flowing liquid by the first liquid pump 2, by detecting the liquid temperature and the engine rotation speed.

In this embodiment, when the liquid temperature t1 is in the first range, it is possible to secure cooling performance by only rotating the first liquid pump 2. In the second range, it is not possible to secure cooling performance by only rotating the first liquid pump 2; the shortage of the amount of flowing liquid is supported by rotating the second liquid pump 1. Furthermore, in the third range, shortage of the amount of flowing liquid is supported by rotating the second liquid pump 1 at a higher speed than in the second range.

It is possible to miniaturize the second liquid pump 1 versus a conventional liquid pump having an electromagnetic clutch.

Accordingly, the installation space of the second liquid pump 1 is not limited, since the arrangement of the second liquid pump 1 with the engine 3 in any position becomes possible. In this embodiment, the second liquid pump 1 is disposed opposite the first liquid pump 2 against the engine 3. Namely, the second liquid pump 1 is disposed at the opposite side of the engine 3 in the axial direction of the crank shaft 34 with respect to the disposed position of the first liquid pump 1. Therefore, the available space around the engine 3 can be used efficiently.

Further, the amount of flowing cooling liquid for cooling the engine 3 is supplied sufficiently because engine cooling device 100 has the first liquid pump 2 and the second liquid pump 1.

In this invention, the amount of flowing liquid is supplied by the rotation of the first liquid pump 2 and the second liquid pump 1. The size of the second liquid pump 1 driven by electricity is not large, and it does not need much electric power to drive the second liquid pump 1.

A preferred embodiment of the present invention, along with the operating principles associated therewith, have been described in the foregoing description. The invention which is intended to be protected herein should not, however, be construed as limited to the particular forms disclosed, as these are to be regarded as illustrative rather than restrictive. Variations and changes may be made by those skilled in the art without departing from the spirit of the present invention. Accordingly, the foregoing detailed description should be considered exemplary in nature, and not limited to the scope and spirit of the invention as set forth in the appended claims.

What is claimed is:

1. A cooling device of an engine comprising:

a first liquid pump driven by decelerated rotation of an engine and for circulating the cooling liquid in the engine; and a second liquid pump driven by electricity and for circulating the cooling liquid in the engine as a supplement to said first liquid pump, wherein the second liquid pump is disposed on an opposite side relative to the first liquid pump against the engine.

2. An engine cooling device in claim 1, wherein the first liquid pump is driven by rotation of a camshaft of the engine.

3. An engine cooling device in claim 1, wherein operation of the second liquid pump is controlled corresponding to a temperature of the cooling liquid and a rotational speed of the engine.

* * * * *